United States Patent [19]

Obino

[11] Patent Number: 4,731,968

[45] Date of Patent: Mar. 22, 1988

[54] CONCRETE FORMWORK COMPONENT

[76] Inventor: Daniele Obino, Ed. - Huberstrasse, 6022 Grosswangen, Switzerland

[21] Appl. No.: 906,621

[22] Filed: Sep. 10, 1986

Related U.S. Application Data

[63] Continuation of Ser. No. 486,218, Apr. 18, 1983, abandoned.

[30] Foreign Application Priority Data

Apr. 23, 1982 [CH] Switzerland ..... 2470/82

[51] Int. Cl.[4] ..... E04C 1/14

[52] U.S. Cl. ..... 52/309.12; 52/426; 52/444; 52/564; 52/565; 52/593

[58] Field of Search ..... 52/309.12, 405, 426, 52/427, 309.4, 309.9, 453, 422, 444, 564, 565

[56] References Cited

U.S. PATENT DOCUMENTS

| | | | |
|---|---|---|---|
| 836,589 | 11/1906 | Layfield et al. | 52/565 |
| 941,080 | 11/1909 | Larsen | 52/565 |
| 994,027 | 5/1911 | O'Beirne | 52/565 |
| 1,329,893 | 2/1920 | Flynn | 52/562 |
| 1,345,156 | 6/1920 | Flynn | 52/444 |
| 1,719,782 | 7/1929 | Roberts | 52/444 |
| 2,181,698 | 11/1939 | Langenberg | 52/564 |
| 2,250,763 | 7/1941 | Hild | 52/712 |
| 3,788,020 | 6/1974 | Gregori | 52/439 |
| 4,223,501 | 9/1980 | De Lozier | 52/309.12 |
| 4,516,364 | 5/1985 | Heider | 52/591 |
| 4,516,372 | 5/1985 | Grutsch | 52/426 |

FOREIGN PATENT DOCUMENTS

| | | | |
|---|---|---|---|
| 256279 | 5/1963 | Australia | 52/591 |
| 2804402 | 8/1978 | Fed. Rep. of Germany | 52/426 |

*Primary Examiner*—John E. Murtagh

*Attorney, Agent, or Firm*—Reed Smith Shaw & McClay

[57] ABSTRACT

Two panel members, preferably with different thickness, made of foamed, hardened plastic material, are connected together by means of cross members made of metal, whereby the connecting flanges of the cross members have small dimensions and are foamed into the panel members with a high resistance to be pulled out. Each panel member comprises, on the upper side, a plurality of plugs and, on the lower side, a plurality of corresponding recesses. Further, there is provided an upper sealing rib and a lower sealing groove. Thereby, a plurality of formwork components can be sealingly assembled to form a shuttering for the erection of a concrete wall. Dovetailed grooves at the inner surface of the panel members ensure a reliable adhesion of the concrete on the panel members. These grooves also serve to receive separating members to form a wall termination.

11 Claims, 8 Drawing Figures

CONCRETE FORMWORK COMPONENT

This application is a continuation of application Ser. No. 486,218, filed Apr. 18, 1983 now abandoned.

BACKGROUND OF THE INVENTION

1. Field of the Invention

The present relates to the art of concrete construction and provides a formwork component for use in concrete construction of walls or the like. The formwork component is adapted to be connected to a plurality of corresponding formwork components for the formation of a shuttering. Such components comprise two parallel panel members interconnected by transverse cross members, the space between the panels being to be filled with concrete for the erection of a wall, e.g. of a building. Finally, the formwork components remain at their places and the panel members act as an insulating layer on the wall surface.

2. Prior Art

Formwork components of the kind described above are known e.g. from the Austrian Pat. No. 326'879 and from the Swiss Pat. No. 519'066. However, the voluminous cross members interconnecting the two panel members are embedded in relatively large projections provided on the inner surface of the two panel members. Thereby, these panel members, made of foamed, hardened plastic material, do not have an even, flat inner surface at all. The projections cause weakened portions in the wall to be erected, which are to be avoided in the interest of good fire protection and sufficient acoustic insulation, but also in view of the fixing of any elements on the finished wall. Furthermore, the static strength of such walls is much less than would be theoretically possible and the freedom in designing the wall dimensions is severely limited due to the coarse screening of the framework components, rendering it difficult to cut individual components to a desired size.

The aforementioned disadvantages are even more pronounced at a formwork component according to Swiss Pat. No. 616'981, which comprises integral cross members made of foamed plastic, because there will result continuous "holes" in the wall once the concrete is filled in and hardened.

A formwork component according to the Austrian Pat. No. 322'804 avoid these "holes", but has the disadvantage of providing cross members made of asbestos which have to be cemented to the panel members in the tension zone. The reliability and durability of such construction is doubtful and there remains the problem to cut the component at the desired position. Evidently, the formwork component according to the last mentioned Austrian Patent is very similar to shuttering elements to be assembled on the construction site, which is not desirable due to economic reasons.

OBJECTS OF THE INVENTION

It is an object of the invention to provide a formwork component of the kind as mentioned hereinbefore which avoids the disadvantages cited above, but offers a number of advantages in view of construction and use. It is a further object of the invention to provide a formwork component which offers good thermal insulation characteristics by using panel members made of a foamed, hardened plastic material like polystyrole or polyurethane, but simultaneously avoids the formation of "holes" in the concrete construction, which are possible passageways for fire, noise and parasites.

Still a further object of the invention is to provide a formwork component for the erection of a concrete wall with improved static strength, free of regions with decreased thickness, which could present severe problems in fixing any auxiliary elements to the wall structure.

A still further object of the invention is to provide a formwork component which guarantees a reliably and durable connection between panel members and cross member and which offers an improved adhesion between the panel members and the concrete.

A final object of the invention is to provide a formwork component offering an improved sealing of the space between the panel members to the outside, thereby preventing the penetration of laitance to the outside of the formwork component, which could result in the formation of thermal bridging.

SUMMARY OF THE INVENTION

According to the invention, there is provided a formwork component for use in concrete construction adapted to be connected to a plurality of corresponding formwork components for the formation of a shuttering. Each component comprises a first and a second panel member made of foamed, hardened plastic material, vertically arranged in a predeterminded distance and extending parallel to each other. A plurality of vertical cross members extends in right angles to the panel members and rigidly connect the first panel member to the second panel member.

Both panel members are provided with substantially flat homogenous surfaces and have equal height and width, whereby the height of the vertical cross members is at least over a part of the cross-section, less than the height of said panel members.

Due to the homogenous, substantially flat construction of the panel members, there are no protrusions or projections in the material of the two panel members which could cause the formations of "holes" in the concrete wall, enabling fire, noise etc. to pass the wall easily. A cross member, at least partially fire-resistant and preferably made of metal, increases this lack of "holes" and improves the static strength of the wall to be erected. An astonishing increase in anchoring force of the cross member may be realized, if the two end regions comprise a plurality of bracing members extending in right angles from the plane of the cross member and preferably being provided on both sides of the cross member in a pressure zone of the two panel members. This anchoring force may be still further increased by providing in the cross members a plurality of apertures adjacent to said bracing members, but situated closer to the centre of the cross members at least partially in a tension zone of the first and second panel members, said pressure zone and said tension zone referring to a load situation of the formwork component when filled with fresh, not yet hardened concrete. A combination of both, bracing members and apertures, ensures to reach a very high strength and stability of the formwork component structure, the size of the cross member in longitudinal direction being very small thereby enabling the formwork component to be cut at nearly any desired position to prepare a component part with the desired size.

An especially favourable and economical manufacture of the cross members may be realized, if the bracing members are constituted by parts of the material of the cross member, punched out and bent to a right angle out of the plane of the cross members. The apertures may be constituted at least partially by the openings in the material of the cross members created by punching and bending out said bracing members.

The inner surface of each of the first and second panel members preferably is provided with a plurality of vertical anchoring grooves with dovetailed cross section which have equal dimensions and distances one to each other. In addition, there may be provided a separating member adapted to be inserted between the first and second panel member, said separating member having a height equal to the heigth of the first and second panel members and being provided with connecting ribs on two opposite faces for a fitting engagement into said dovetailed anchoring grooves. Thereby, it is possible to realize a wall with a termination exactly at the desired position. A still more precise positioning of the separating member and thereby of the wall termination may be achieved, if the dovetailed anchoring grooves in the first panel member are in staggered arrangement relative to the dovetailed anchoring grooves in the second panel member. Simultaneously, the connecting ribs on the both opposite faces of the separating member are in staggered arrangement by the same amount, so that the separating member can be inserted between the first and second panel member in a first position and by turning it by 180° in a second position, which differs from said first position by a distance corresponding to half of the distance between two adjacent anchoring grooves.

The anchoring grooves offer the further advantage of an improved adhesion of the concrete on the first and second panel members. The concrete enters the dovetailed grooves and provides a safe connection between wall and panel members, even if the distance between the cross members is relatively large.

With the known components, there is a further problem of connecting individual components placed above each other. To avoid a displacement also in longitudinal direction, it has been proposed to provide ribs and recesses also in crosswise direction, as is described in Swiss Pat. No. 616'981. But the consequence is a quite coarse screening. To avoid this disadvantage, the formwork component of the present invention comprises on each of the first and second panel members and/or on each of the separating members a plurality of substantially cylindrical plugs arranged in a row preferably on the upper front face and a plurality of correspondingly shaped and correspondingly arranged recesses on the opposite, preferably lower front face. The recesses on the lower face are less subjected to contamination, and the space between the plugs on the upper face can easily be kept clean.

In order to prevent any laitance to penetrate the shuttering made of a plurality of individual formwork components, there may be provided sealing ribs and sealing grooves, as can be seen from the drawings, which cooperate and ensure a tight connection between adjacent formwork components. Crosswise arranged, further sealing grooves are useful in corner constructions and they do not have any negative influence in constructing a straight wall, as they are sealed by the ribs of the adjacent formwork components.

In some cases, it may be advantagous to provide a thicker, outer panel member and a thinner, inner panel member to improve the thermal insulating characteristic of the wall.

After all, a relatively fine screening in the order of one inch unit screen distance can be realized, or even less, if desired. The outer surfaces of the panel members of each formwork component may be provided with cutting indices in the same screening to assist in cutting the components into smaller dimensions and preventing a cross member to be destroyed in cutting the component.

BRIEF DESCRIPTION OF THE DRAWINGS

In the following, there will be described an embodiment of the formwork component according to the invention, with reference to the accompanying drawings, in which.

DESCRIPTION OF A PREFERRED EMBODIMENT

Figure 1:
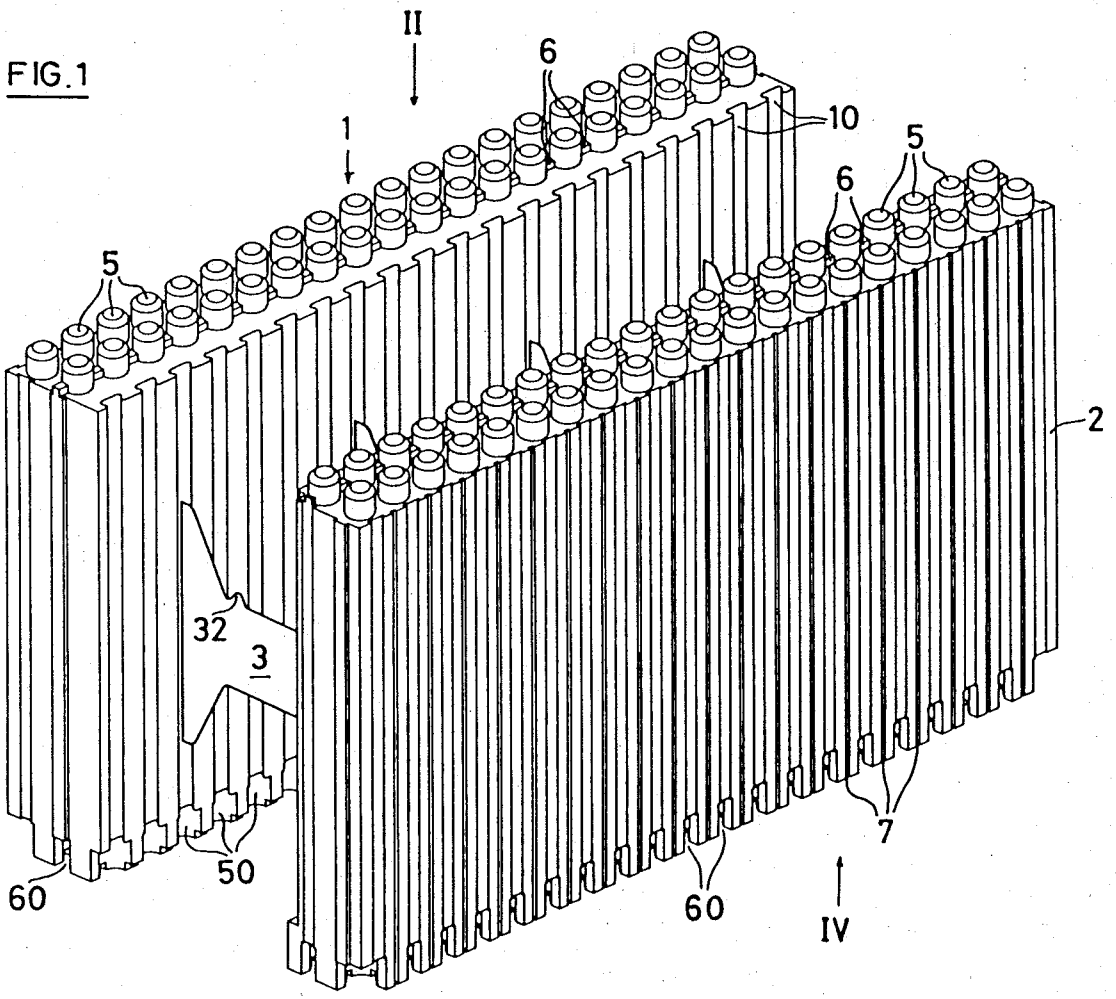
FIG. 1 shows a perspective view of a formwork component.
Figure 2:
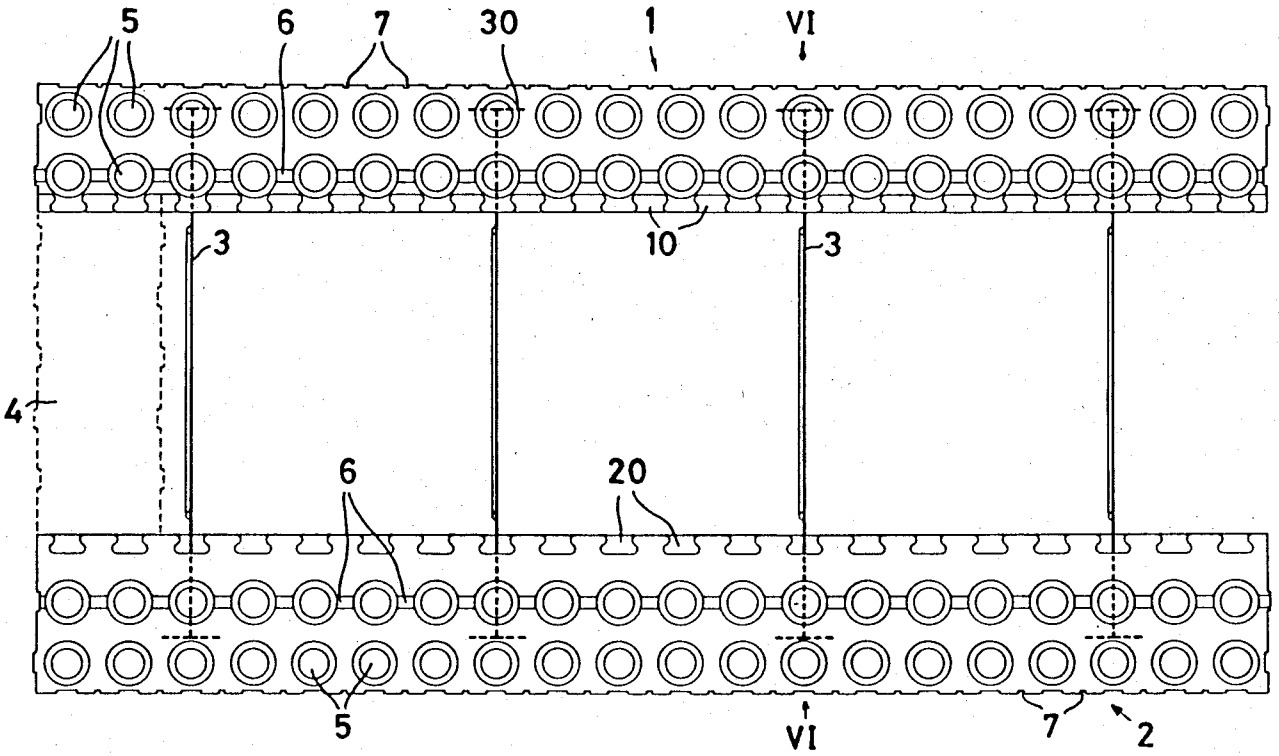
FIG. 2 shows a view on the component of FIG. 1 in the direction of arrow II.
Figure 3:
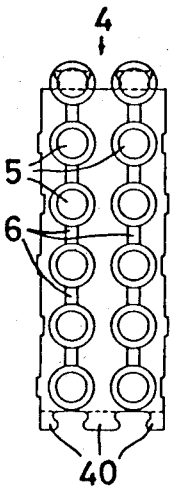
FIG. 3 shows a view on a separating member.

The formwork component according to FIG. 1 comprises two panel members, i.e. a thicker panel member 1, normally at the outside of a wall to be constructed, and a thinner panel member 2, normally at the inner side of the wall. The two panel members are arranged parallel to each other and are rigidly connected one to each other by means of steel cross members 3. These cross members 3 are foamed into the panel members 1 and 2, which are made of a foamed, hardened plastic material.

Figure 4:
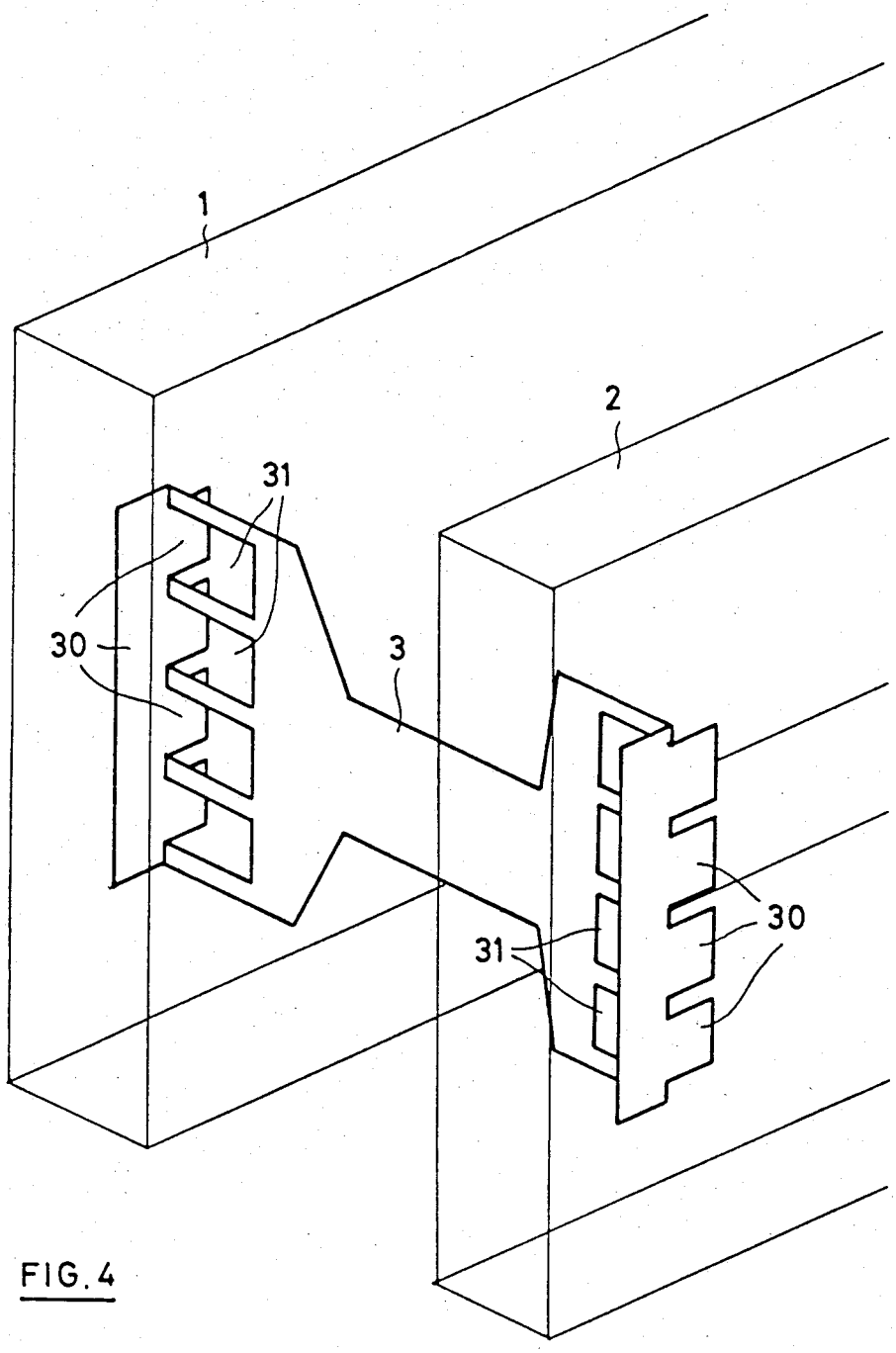
FIG. 4 shows a schematic, perspective view of the cross member, connected to the panel members.

As can be seen from FIG. 4, the cross member 3 basically consists of a piece of sheet metal and is equipped on its both ends with bracing members 30, generally extending in right angles to the plane of the cross member 3. The bracing members 30 are partially punched out of the material of the cross member 3 and are bent out of the plane of the cross member, whereby apertures 31 are created. These apertures, which may be further enlarged after partially punching out the bracing member 30, serve for ensuring a reliable anchoring of the cross members 3 in the material of the foamed panel members 1 and 2, together with the bracing members 30, which have the same purpose. By means of this punching process, the bracing members 30 and the cross members 3 in all can be fabricated rationally and nearly without any loss of material.

Anybody skilled in the art of manufacturing and using such formwork components can easily recognize especially from FIGS. 2, 4, 5, 7 and 8, that the bracing members 30 are embedded in a pressure zone of the panel members 1 and 2, i.e. in a zone which is subjected to a pressure load effected by the still fresh, not yet hardened concrete filled in the space between the two panel members arranged parallel to each other. This pressure load is exerted in longitudinal direction of the formwork component.

Figure 6:
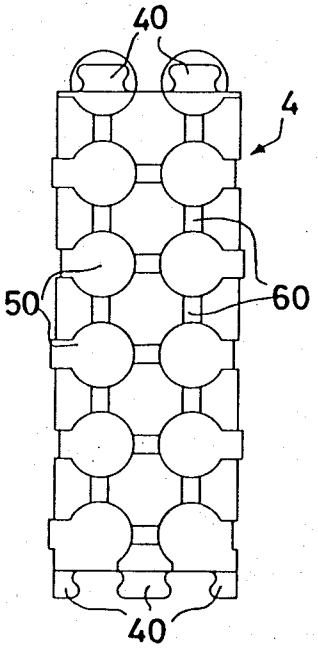
FIG. 6 shows an underside view of a separating member.
Figure 5:
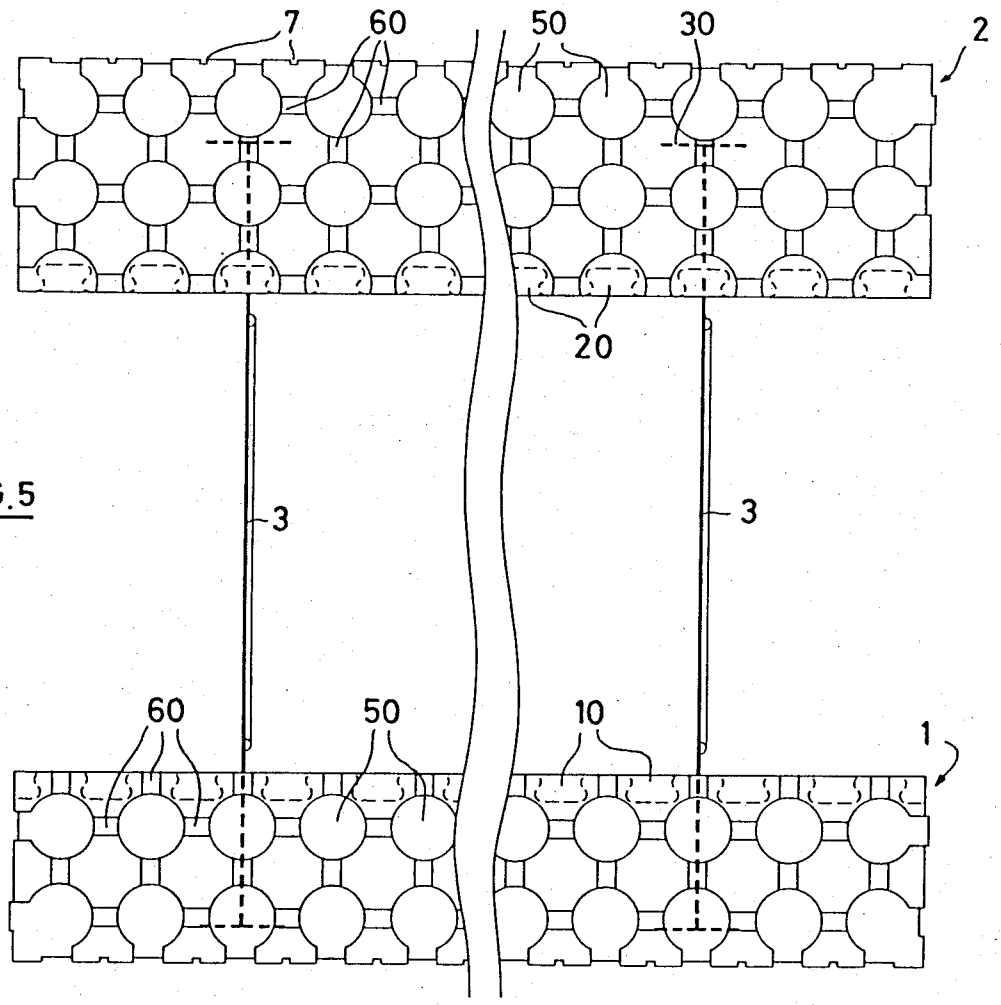
FIG. 5 shows a partial view of the underside of the component of FIG. 1 in the direction of arrow IV.
Figure 8:
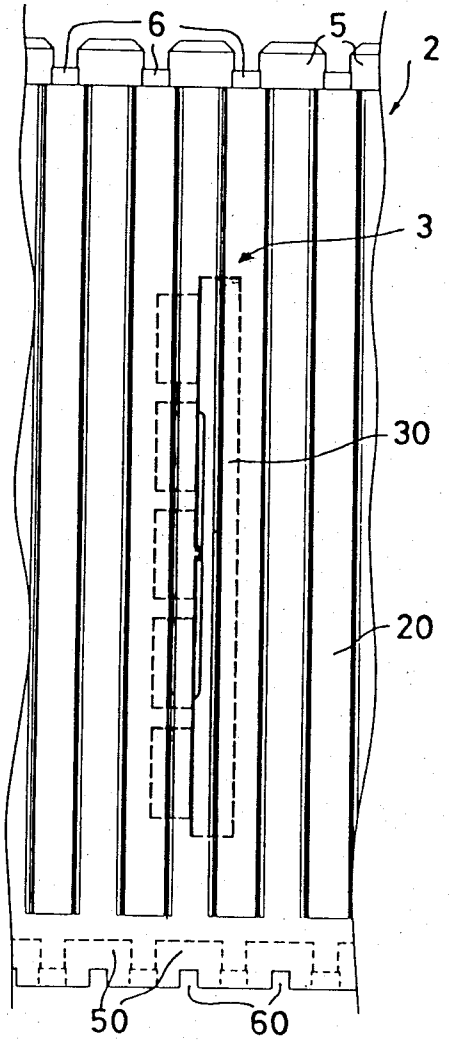
FIG. 8 shows a partial section along the line VII—VII in FIG. 7.
Figure 7:
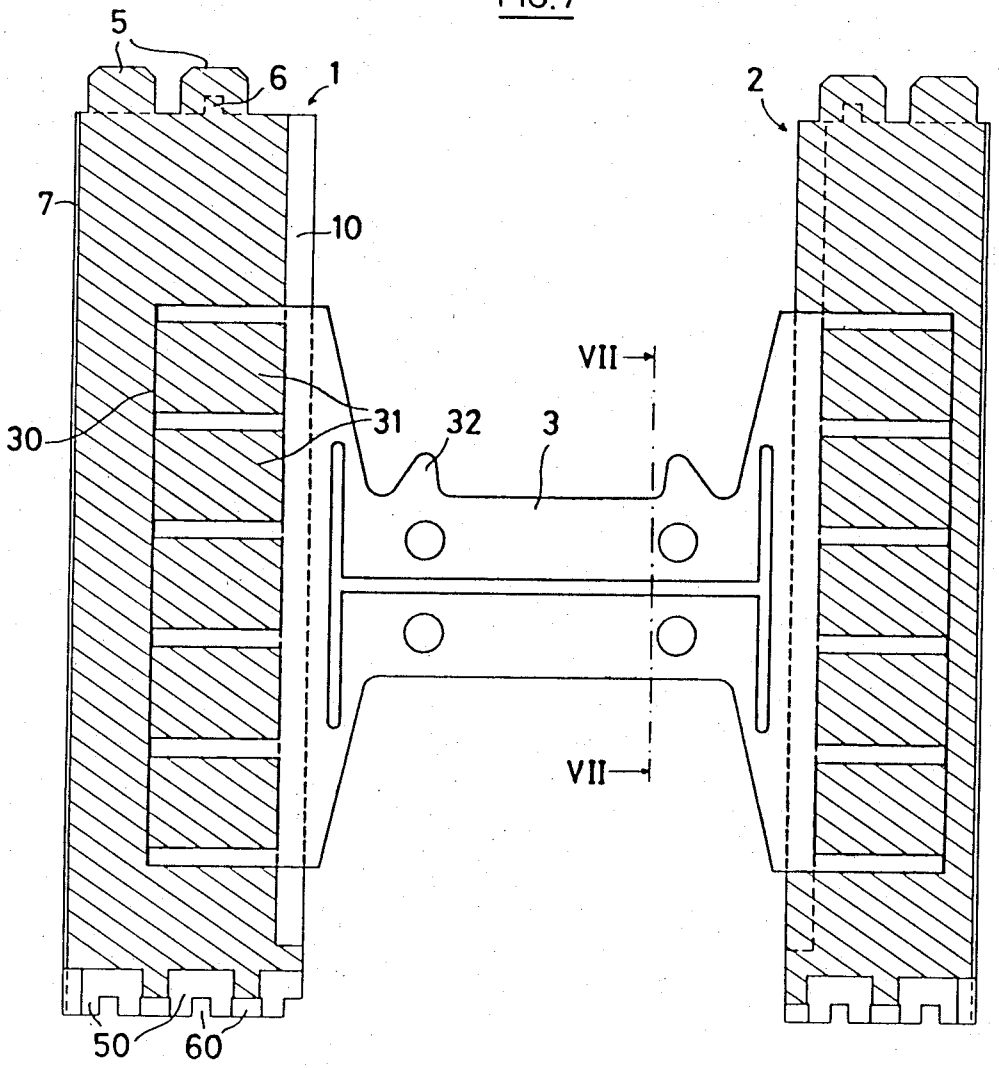
FIG. 7 shows a cross section along the line VI—VI in FIG. 2.

In contrary, as can be seen from FIGS. 4 and 6, the apertures are disposed, at least partially, in a zone which is subjected to a tension force in the longitudinal direction of the component, created again by the concrete filling in it's fresh, not yet hardened condition. Thereby it is ensured, that the both panel members 1 and 2 are rigidly connected one to each other by the cross members 3 and any creation of cracks in the concrete is prevented.

The cross members 3 are provided with cam-like protrusions 32 which help in positioning reinforcing steel bars that may be required to be included into the concrete wall structure. Within the space between the two panel members 1 and 2, the cross members 3 have a very small height in vertical direction, which helps to avoid "holes" in the concrete wall structure, and thereby ensures a statically stable, very rigid concrete wall to be erected.

The inner surfaces of the panel members 1 and 2 are equipped with a plurality of vertically extending grooves 10 and 20, having a dovetailed cross section and being arranged in uniform distance. The grooves 10 on the panel member 1 are in staggered arrangement to the grooves 20 on the panel member 2, the staggered distance corresponding to half of the distance between two adjacent grooves. A separating member 4, adapted to be inserted between the two panel members 1 and 2, comprises at its frontal surfaces ribs 40, which correspond in size and shape to the dovetailed grooves 10 and 20 in the panel members 1 and 2. In a similar manner, as described in connection with the grooves 10 and 20, the ribs 40 on the separating member 4 are in staggered arrangement with the possibility to fit the separating member in a first position between the two panel members as well as in a second position by turning the separating member about 180°, so that said second position differs from said first position by a longitudinal distance corresponding to half the distance between two adjacent dovetailed grooves.

Each of the panel members 1 and 2 and each of the separating members 4 comprise a plurality of substantially cylindrical plugs 5, which are arranged in e.g. two parallel rows on the upper, frontal face of the panel members 1, 2 and the separating members 4, respectively. The distance between two adjacent plugs 5 corresponds to the distance between two adjacent grooves 10 or 20. On the opposite, lower frontal face of the panel members 1, 2 and of the separating members 4, respectively, there is provided a plurality of correspondingly shaped and correspondingly arranged recesses 50. On placing one of the formwork components upon another one, the plugs 5 of the lower one fit the recesses 50 of the upper one and thereby define the exact, relative position of these two components.

The said upper frontal face of the panel and separating members, equipped with said cylindrical plugs, further comprises sealing ribs 6 extending from said frontal faces to a height less than the height of these plugs. The rib 6 extends between the plugs 5 and thereby interconnects each plug 5 with its adjacent ones within a row. The opposite, lower frontal face of the panel members 1, 2 and the separating members 4 comprise a sealing groove 60 crossing the said recesses 50 and being intended to sealingly receive the said sealing rib 6 of a formwork component placed thereupon to seal the gap between adjacent components. In this way, a penetration of laitant is effectively prohibited.

All the aforementioned structural elements, i.e. the cross members 3, the grooves 10 and 20, the plugs 5, the recesses 50, the sealing ribs 6 and the sealing grooves 60 are arranged in a uniform screen, whereby the width of the bracing members 30 of the cross members 3 is less then the unit screen distance. Thereby, it is ensured, that each formwork component may be cut within this unit screen distance, which preferably is in the region of one inch or even less, to a desired dimension, without the danger, that one of the cross members 3 is damaged during cutting operation. To assist this cutting operation, the outer surface of the panel members 1 and 2 may be provided with cutting indices in the form of shallow, longitudinal, vertically and parallelly extending grooves 7, which have a uniform, unit screen distance.

What I claim is:

1. A formwork component for use in concrete construction adapted to be connected to a plurality of corresponding formwork components for the formation of a shuttering, each component comprising:

a first and a second panel member made of foamed, hardened plastic material, being vertically arranged in a predetermined distance and extending parallel to each other, a plurality of vertical cross members extending in right angles to said panel members and rigidly connecting said first panel member to said second panel member, said first and second panel members being provided with substantially flat homogenous surfaces and having equal height and width; and wherein said vertical cross members comprise on their two end regions a plurality of bracing members extending in right angles from the plane of said cross members and being provided on both sides of the cross members in a pressure zone of said first and second panel members, said vertical cross members further comprising a plurality of apertures adjacent to said bracing members, but situated closer to the center of said cross members at least partially in a tension zone of said first and second panel members, said pressure zone and said tension zone referring to a load situation of the formwork component when filled with fresh, not yet hardened concrete.

2. A formwork component according to claim 1, wherein said vertical cross members are made at least partially of fire-resistant material.

3. A formwork component according to claim 1, wherein said bracing members are constituted by parts of the material of said cross members punched out and bent to a right angle out of the plane of said cross members, and wherein said apertures are constituted at least partially by the openings in the material of said cross members created by punching and bending out said bracing members.

4. A formwork component according to claims 1, 2, or 3 wherein the inner surface of each of said first and second panel members is provided with a plurality of vertical anchoring grooves with dovetailed cross section which have equal dimensions and distances one to each other.

5. A formwork component according to claim 4, wherein said dovetailed anchoring grooves in said first panel member are in staggered arrangement relative to said dovetailed anchoring grooves in said second panel member, and wherein said connecting ribs on the both opposite faces of said separating member are in staggered arrangement by the same amount, thereby enabling said separating member to be inserted between said first and second panel member in a first position and by turning it by 180° in a second position, which differs from said first position by a distance corresponding to half of the distance between two adjacent anchoring grooves.

6. A formwork component according to claim 1, wherein each of said first and second panel members comprises a plurality of substantially cylindrical plugs arranged in at least one row on the upper or lower front face and a plurality of correspondingly shaped and correspondingly arranged recesses on the opposite, lower or upper front face.

7. A formwork component according to claim 6, wherein said upper or lower front face equipped with said at least one row of plugs further comprises a sealing rib extending from the surface of said front face to a height less than the height of said plugs and interconnecting each of said plugs with the adjacent ones of a row, and wherein said opposite, lower or upper front face comprises a sealing groove crossing said recesses and being adapted to sealingly receive said sealing rib of an adjacent formwork component.

8. A formwork component according to claim 7, wherein said cross members, said anchoring grooves, said plugs, said recesses, said sealing ribs and said sealing grooves are arranged in a uniform screen at least in the longitudinal direction of the formwork component, each of said cross members having a dimension in said longitudinal direction which is less than a unit screen distance of said uniform screen.

9. A formwork component according to claim 8, wherein said unit screen distance is one inch, and wherein the outer surfaces of said first and second panel members comprises cutting indices for cutting the formwork components according to said uniform screen.

10. A formwork component according to claims 1, 2, or 3, wherein said first and said second panel members have unequal thickness.

11. A formwork component for use in concrete construction adapted to be connected to a plurality of corresponding formwork components for the formation of a shuttering, each component comprising a first and a second panel member made of foamed, hardened plastic material, being vertically arranged in a predetermined distance and extending parallel to each other, a plurality of vertical cross members extending in right angles to said panel members and rigidly connecting said first panel member to said second panel member, each of said cross members being made at least partially of metal material, said first and second panel members being provided with substantially flat homogenous surfaces and having equal height and width, said surfaces having recesses and protrusions with depth and height measurements respectively substantially less than the thickness of said panel, and the height of said vertical cross members being at least partially less than the height of said first and second panel members; and said vertical cross members are made of sheet metal and comprise on their two end regions a plurality of bracing member extending in right angles from the plane of said cross members and preferably being provided on both sides of the cross members at least partially in a compression zone of said first and second panel members, said vertical cross members further comprising a plurality of apertures adjacent to said bracing members at least partially in a tension zone of said first and second panel members, said pressure zone and said tension zone referring to a load situation of the formwork component when filled with fresh, not yet hardened concrete.

* * * * *

UNITED STATES PATENT AND TRADEMARK OFFICE

CERTIFICATE OF CORRECTION

PATENT NO. : 4,731,968

DATED : March 22, 1988

INVENTOR(S) : Daniele Obino

It is certified that error appears in the above-identified patent and that said Letters Patent is hereby corrected as shown below:

On the title page, item [73], the assignee should be inserted to read

-- Assignee: Aregger AG, Bauunternehmung Mühlemoos, CH-6018 Buttisholz, Switzerland --.

Signed and Sealed this

Fifth Day of January, 1993

*Attest:*

*Attesting Officer*

DOUGLAS B. COMER

*Acting Commissioner of Patents and Trademarks*